US005370177A

United States Patent [19]

Fey et al.

[11] Patent Number: 5,370,177

[45] Date of Patent: Dec. 6, 1994

[54] CONTROLLABLE-TEMPERATURE ROLL

[75] Inventors: Gustav Fey; Klaus-Peter Schramm, both of Siegen; Ludwig Hellenthal, Kirchhundem; Berthold Krämer, Netphen; Walter Patt, Siegen; Jaxa Von Schweinichen, Netphen, all of Germany

[73] Assignee: Walzen Irle GmbH, Netphen, Germany

[21] Appl. No.: 179,966

[22] Filed: Jan. 11, 1994

[30] Foreign Application Priority Data

Jan. 12, 1993 [DE] Germany ..... 4300541

[51] Int. Cl.[5] ..... F28D 11/02

[52] U.S. Cl. ..... 165/89; 492/46

[58] Field of Search ..... 165/89; 492/46

[56] References Cited

U.S. PATENT DOCUMENTS

| | | | |
|---|---|---|---|
| 3,135,319 | 6/1964 | Richards | 165/89 |
| 4,050,510 | 9/1977 | Theysohn | 165/89 |
| 4,955,433 | 9/1990 | Zaoralek | 165/89 |
| 5,152,333 | 10/1992 | Barbe et al. | 164/423 |

FOREIGN PATENT DOCUMENTS

| | | | |
|---|---|---|---|
| 2175670A | 12/1986 | United Kingdom | 165/89 |

*Primary Examiner*—Allen J. Flanigan
*Attorney, Agent, or Firm*—Herbert Dubno

[57] ABSTRACT

A thermally regulatable calender roll, e.g. for drying paper webs, can have a roll body centered on a pair of flanged stub shafts whose flange on at least one end of the roll body can be provided with at least one annular groove or chamber communicating with the heating bores of the roll body. The pitch circle of the heating bores is located outwardly of the pitch circle of the bolts attaching the flanges to the roll body and the heating medium is fed through at least one of the stub shafts to the annular groove and the bores.

1 Claim, 7 Drawing Sheets

CONTROLLABLE-TEMPERATURE ROLL

FIELD OF THE INVENTION

The present invention relates to a temperature-controllable roll, especially, for calenders and, more particularly, to a heatable roll of the type in which bores for a heating medium lie close to but inwardly of the cylindrical rolling surface of the roll.

BACKGROUND OF THE INVENTION

In DE GM 84 10 839 and 84 36 564, controllable temperature rolls are described in which the rolls can be heated or cooled with a thermal transfer medium, i.e. a heating or cooling fluid, which can pass through bores close to the cylindrical surface of the roll.

These bores, which extend axially through the roll body communicate with axial bores in the shaft stubs on which the roller is journalled for rotation about the roll axis.

Rolls of this type are widely used in calenders of all types.

The bores in the roll body generally communicate with chambers or hollow spaces formed in the flanges and supplying or distributing the thermal medium. With direct connection of these flanges to the roll body, which has been found to be necessary in earlier systems to provide the openings of the heating bores which communicate with the disk-shaped chambers relatively deeply below the rolling surface since the diameter of the chambers has, in the past, been required to lie inwardly of the circle of screws or bolts by means of which the flanges are affixed to the ends of the roll body.

With the heat transfer bores lying relatively deeply below or inwardly of the surface of the roll, the thermal inertia of the roll is significant, i.e. it is impossible to rapidly vary the roll temperature as may be required under many conditions. Furthermore, it is difficult to minimize the temperature gradient within the roll body where the heat transfer bores are spaced substantially from the peripheral roll surface.

Of course, it is possible to incline the bores in the roll body to allow the bolts or screws to be cleared by the flow passages which can thus run closer to the peripheral surface of the roll, but roll constructions of this type have been found to be inordinately costly and time consuming to fabricate.

OBJECTS OF THE INVENTION

It is, therefore, the principal object of the present invention to provide a controlled-temperature roll, especially a calender roll, which is free from the drawbacks enumerated above and can be fabricated at relatively low cost.

Another object of this invention is to provide a calender roll with minimal thermal inertia, i.e. which can be rapidly adjusted in temperature by varying the temperature of the heat transfer medium passed therethrough.

Another object of this invention is to provide an improved heatable calender roll of the type described generally above but which allows the heating passages to lie close to the peripheral cylindrical surface of the roll body and thus permits an improved temperature field to be established at comparatively low fabrication costs.

SUMMARY OF THE INVENTION

These objects and others which will become apparent hereinafter are attained, in accordance with the invention in a calender roll in which a roll body, preferably of hollow cylindrical configuration has a pair of flanges stub shafts affixed to the ends thereof by circular arrays of bolts extending parallel to the axis and passing through the flanges. The roll body is formed with an array of heat transfer bores close to the peripheral rolling surface of the roll body and the flanges form together with the roll body chambers into which these heat transfer bores open. Axial bores communicating with the chambers and formed in the shaft stubs permit the heat transfer medium to be delivered to the heat transfer bores and discharged from the roll.

According to the invention, the radius of the pitch circle of the peripheral heating bores exceeds the radius of the pitch circle of the bolts and the mouths of the heating bores are connected with the chambers which can be formed by grooves in the flanges and/or bores formed therein.

This construction permits the use of disk-shaped or annular hollow spaces or chambers, minimizes the fabrication work since the flanges can be readily machined to form the chambers and nevertheless enables the heating bores to lie close to the surface and the flanges to be reliably secured to the roll bodies. The feed and discharge can be effected through one or both flanges and the heating bores can be divided into groups of 1 or 3 bores each or groups of 2 or 4 bores each without difficulty.

More particularly, a controlled-temperature roll can comprise:

- a roll body having a cylindrical peripheral surface and a multiplicity of mutually parallel heat transfer bores for a heating medium extending parallel to an axis of the roll body and terminating at respective opposite ends of the roll body, the bores lying in a circular array close to the peripheral surface and such that axes of the bores lie generally along a bore array circle centered on the axis of the roll body;
- a respective flanged stub shaft at each of the ends, each flanged stub shaft comprising:
  - a circular flange lying against the respective end of the roll body,
- a shaft stub projecting axially from the respective flange and coaxial with the flange and the roll body, and
  - axial stub bores formed in at least one of the shaft stubs for delivering the heating medium to and discharging the heating medium from the heat transfer bores;
- a respective circular array of flange bolts extending parallel to the axis of the roll body and traversing each flange for securing the respective flange to the respective end of the roll body, the flange bolts having flange bolt axes lying along a flange bolt circle centered on the axis of the roll body,
- a radius of the bore array circle exceeding a radius of the flange bolt circle; and
- passages formed in faces of the flanges confronting the ends of the roll body, connected to the stub bores and communicating with the heat transfer bores whereby mouths of the heat transfer bores open into the passages.

According to a further feature of the invention, angular regions between each 2, 3 or 4 heating bores are free from grooves and/or bores of the flange and in the limited pitch circle inwardly of the heating bores in these angular regions, respective bolts are provided to secure the flange to the roll body.

In the spaces or bores in the flanges, i.e. the passages formed in faces of the flanges confronting the ends of the roll body, can be annular grooves. The flanged stub shafts, moreover, may have centering bosses received within the hollow roll body and thereby coaxially aligning the stub shafts and the roll body, the centering bosses likewise being provided with the aforementioned passages.

The annular grooves can extend within or be cutouts of the roll body.

According to a feature of the invention, the annular grooves can be partitioned by annular walls, e.g. a conical disk, into two or more compartments or annular grooves and the annular grooves can be connected with the bores of the shafts by connecting bores or passages.

The connecting bores or passages can be fewer in number than the groups of heating bores communicated in series and can have flow cross sections which are greater than the grouped heating bores or diameters which are correspondingly greater.

Radial grooves with transverse walls or partitions, connecting tubes or communicating housing can be provded and according to yet another feature of the invention, neighboring mouths of the heating bores can be connceted by bridges or grooves in series with one another.

The supply and discharge bores extending through the shafts can be closed off from communication with the interior of the roll body which can be maintained free from flooding by disk-shaped partitions or walls.

With the two sided connection of heating bores in groups of various numbers, tubes can pass through the roll body or can be incorporated therein.

The connecting bores, grooves, end regions of the heating bores or the corresponding parts of the flanges and the like can be thermally insulated by respective insulating bodies e.g. tubes, shells, sleeves or the like.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
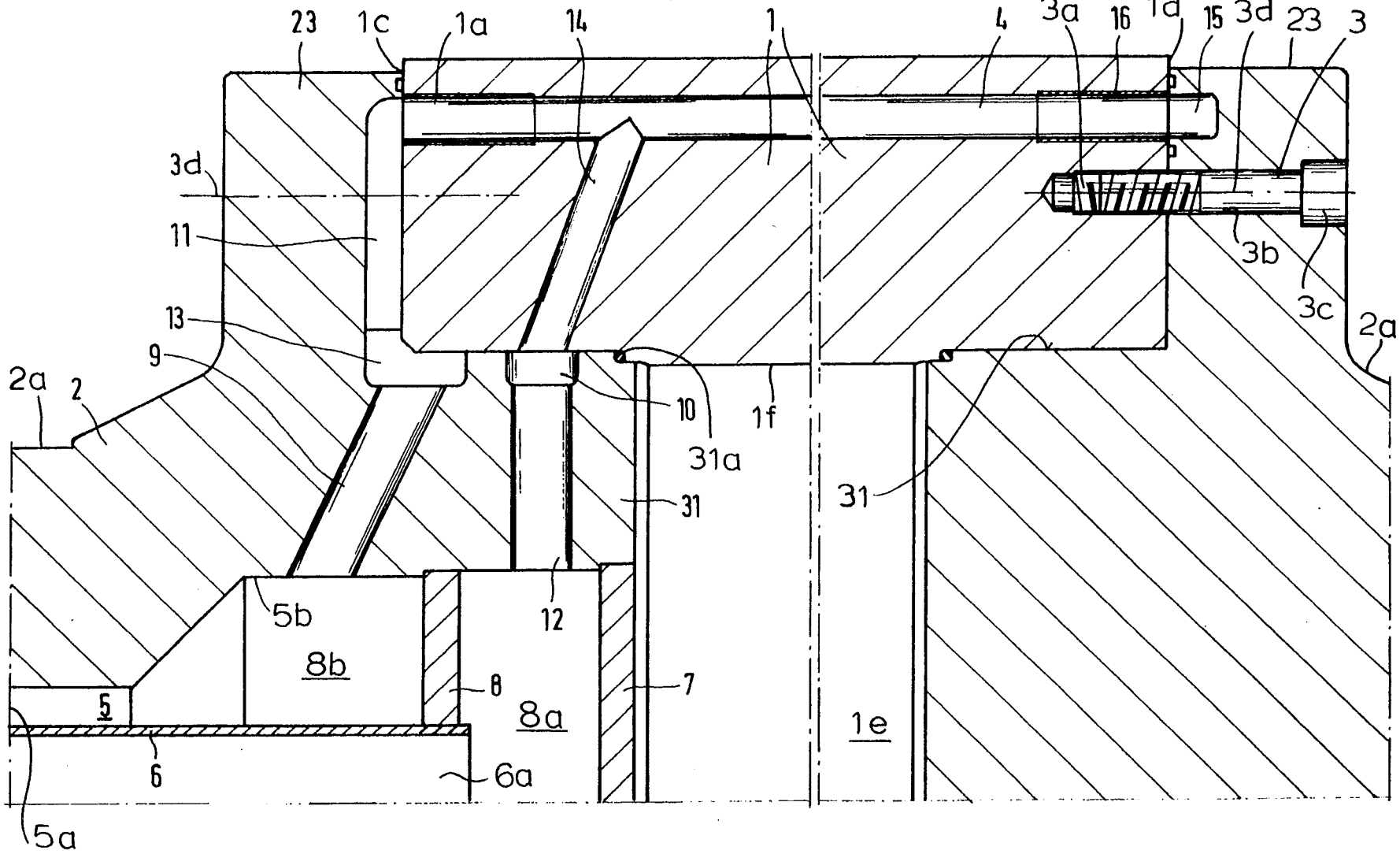
FIG. 1 is a partial axial cross section through a heatable calender roll in which each second heating bore is provided with a feed bore which is inclined.

FIG. 1 shows a half section of a calender roll broken in the middle and showing the flange connections of the flanged stubs, whose shafts are also broken away, to the roll body of a heatable calender roll.

The cylindrical roll body 1 has a rolling surface 1*a* and is connected with the flanges 23 of the flanged stub shafts, by means of screws or bolts 3 which are threaded into bores 3*a* of the roll body 1 and transverse bores 3*b* of the flanges 23, having heads 3*c* countersunk in the latter. The bolts 3 have axes 3*d* which lie along respective pitch circles as will be described in greater detail with respect to FIG. 2 and are angularly equispaced about the axis 1*b* of the roll. The shaft stubs 2*a* of the flanged stub shafts are, of course, coaxial with the cylindrical body 1 and project in opposite axial directions from the roll body to be received in respective journals supporting the roll for rotation about the axis 1*b*.

Relatively close to but inwardly of the rolling surface 1*a* of the roll body 1 a plurality of peripheral heating bores 4 which extend parallel to one another and parallel to the axis 1*b* in angularly equispaced relationship around the latter. The bores 4 open at the end faces 1*c* and 1*d* of the roll body 1.

The supply of the heating medium or thermal medium to the heating bores 4 is effected via one of the flanged stub shafts 2 and depleted heating medium can be discharged through the same or another stub shaft 2 so that the roll can be used as a driven roll of a calender or as an entrained or idler roll thereof. In the most advantagous configuration both the supply and discharge of the thermal medium is effected through a common coupling to only one of the shaft stubs.

Figure 2:
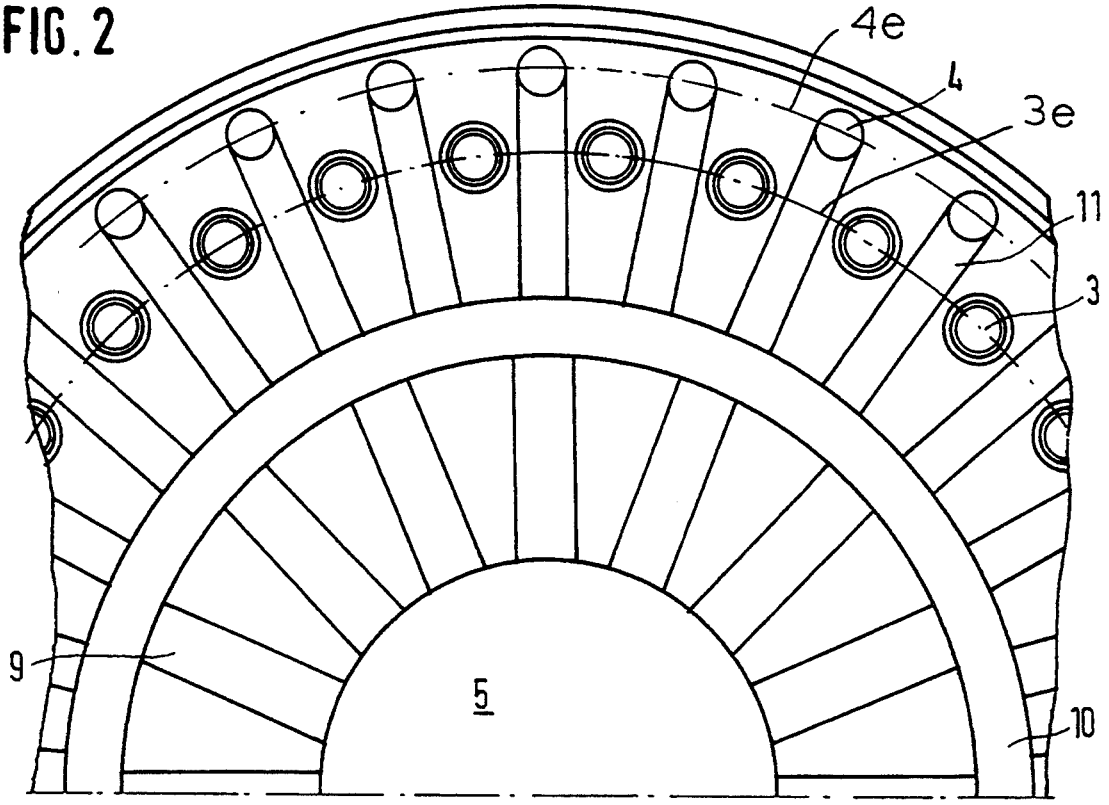
FIG. 2 is a fragmentary transverse section through the calender roll of FIG. 1.

In the embodiment illustrated in FIGS. 1 and 2, the lefthand flanged stub shaft 2 is formed with an axial bore 5 subdivided by an inlet tube 6 or a tubular partition, into an outer passage 5*a* and an inner passage 6*a*.

The outer passage 5*a* opens into a larger bore 5*b* which is closed axially by a partition disk 8. The inner passage 6*a* opens into a chamber 8*a* between the partition 8 and a partition disk 7 which closes off the bore 5*b* from the interior 1*e* of the roll body 1.

The chamber 8*a* ahead of the partition 8 is connected to inclined return bores 9 which lie in radial planes and communicate with an annular groove 13 formed in the base of a centering boss 31 of the flanged stub shaft and which has an O-ring seal 31*a* sealed against an annular step 1*f* of the rolled body 1. The boss 31 serves to center the stub shaft relative to the roll body 1.

The annular groove 13 at the base of the boss 31 of the lefthand flange stub shaft 2 communicates with radial grooves 11 formed in the end face of the flange 23 juxtaposed with the end face 1*c* of the body 1 and running to the mouths of the bores 4 opening at the end face 1*c*.

Figure 4:
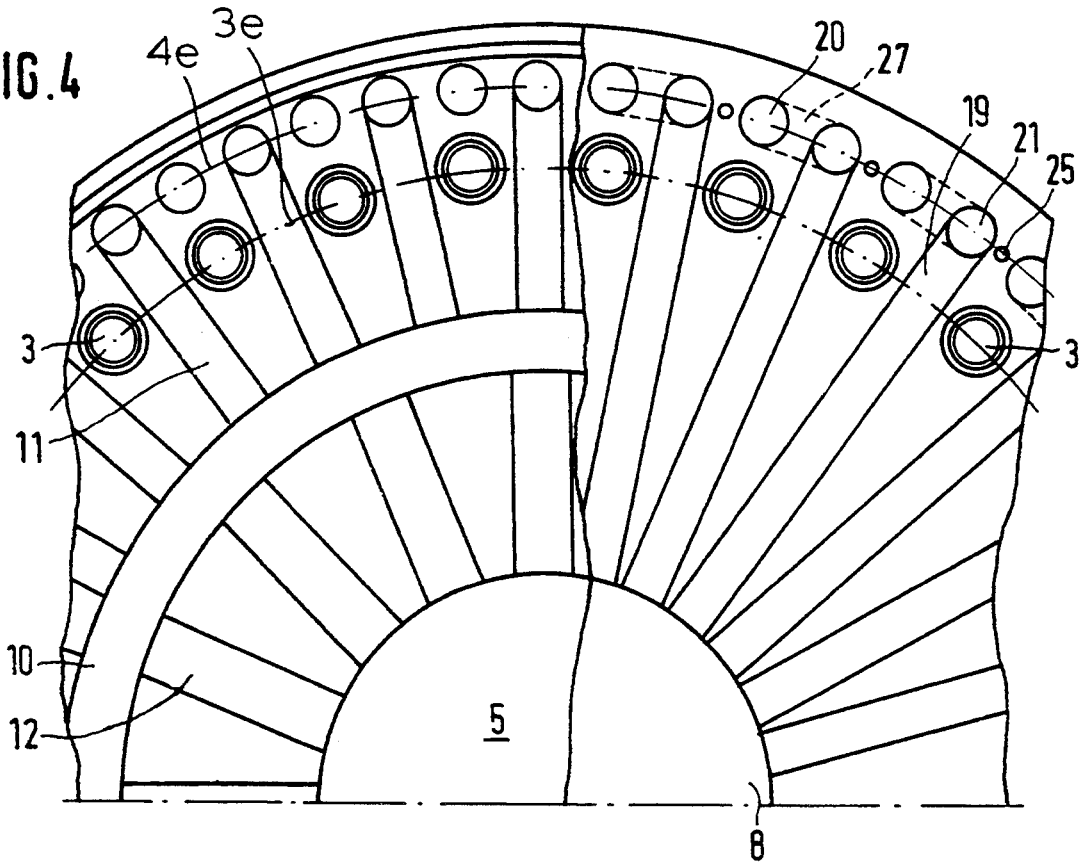
FIG. 4 is a transverse section corresponding to FIG. 3, partially taken along the sectional plane represented at IV of FIG. 3 and partially in a plane offset therefrom.

At the opposite end face 1*d* of the roll body 1, the mouths of bores 4 open into bridge channels or grooves 15 formed in the juxtaposed end face of the respective flange 23 and connecting successive bores 4 together, e.g. in the manner shown by the bridges 27 in FIG. 4.

Feed bores 14 can communicate with the alternating bores 4 which do not conncet to grooves 11 and are also inclined to the axis 1*b* but lie in respective radial planes.

The bores 14 communicate with angular grooves 10 in the centering boss 31 of the lefthand flanged stub shaft 2. The angular groove 10, moreover, communicates via radial bores 12 with the chamber 8*a* between the partitions 7 and 8 and delivering the thermal medium from a rotary distributor to the roll via the passage 6*a* in the tube 6.

The thermal medium can thus be passed through the roll in a recirculating system which can include a heating and/or cooling to control the temperature of the roll.

Instead of bridges 15 between successive heating bores 4, a continuous groove can connect all of the bores 4 or selected numbers of bores. The bores 4 can thus be transversed in parallel or in series by the thermal medium.

Each groove 11 and each said bore 14 may thus connect a group of heating bores 4 in the heating medium circulation and to the annular grooves 10 and 13 respectively. The bores 12 and 9 can be of a number greatly reduced from the number of bores 14 and grooves 11 and, of course, the number of bores 14 and grooves 11 will be less than the number of heating bores 4 but of correspondingly larger cross section so that there is no overall flow cross section reduction between the bores 9 and 21 on the one hand and the passages 11 and 14 on the other and between the passages 11 and 14 on the one hand and the bores 4 on the other.

Generally, it should be noted that the grooves 11 are provided in the flanged stub shaft which is usually of a softer material than the roll body 1 and thus is easier to machine with these grooves.

In any case, as FIG. 2 will show, the bolts 3 lie between grooves 11 which are so spaced that there is a sufficient field for these screws and the tapped bores 3*a* in which they are received.

At the mouths of the bores 4 thermally insulated sleeves 16 can be inserted to prevent overheating of the ends of the roll body 1.

It is, however, possible to eliminate the said bores 14 in the roll body 1. As can be seen from FIGS. 3 and 4, for example, in which similarly functioning parts are represented by the same reference numerals as in FIGS. 1 and 2, the calender roll has a hollow cylindrical roll body 1 connected by the bolts 3 to the flanged stub shafts 2. Where as well as in FIG. 1, a section revealing the bolt 3 is shown at the righthand end of the roll while a section is taken between the bolts 3 at the lefthand end of the roll. In both cases, the axes of the bolts can be seen.

The pitch circle 3*e* of the bolts lies within the pitch circle 4*e* of the bores 4. The pitch circle in each case is the circle along which the equispaced axes of the bolts and the bores, respectively, lie.

Figure 3:
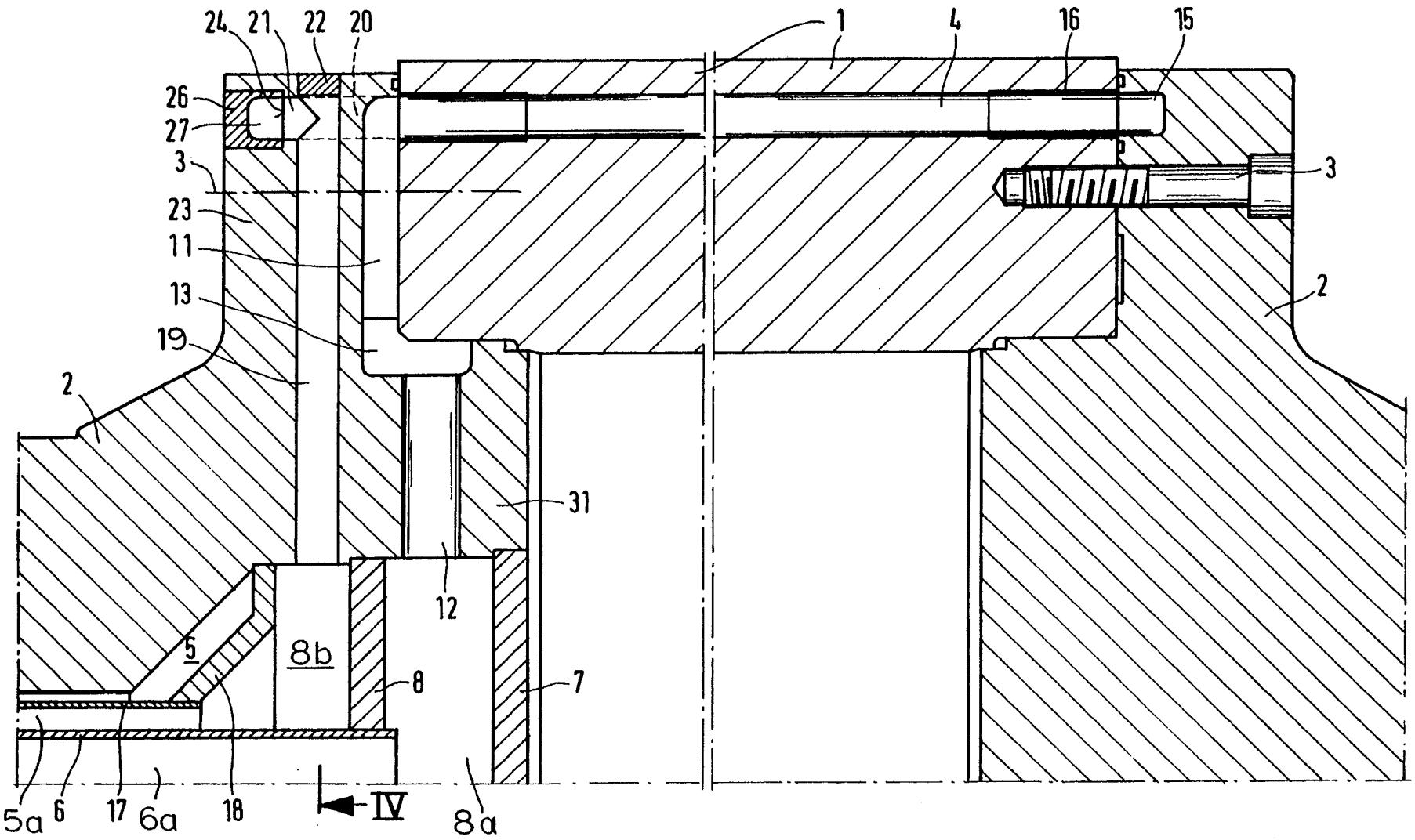
FIG. 3 is a view similar to FIG. 1 showing a calender roll with connecting bores further exclusively in one of the flanged stub shafts.

In FIGS. 3 and 4 as in the embodiment of FIGS. 1 and 3, the feed of the heating medium is effected through the lefthand flanged stub shaft 2, in the bore 5 of which a said tube 6 is provided which is centered by means of the partition disk 8 while the partition disk 9 closes off the space within the roll body 1 from the exterior so that the interior of the roll body is not flooded with the heating medium and there is no need to provide within the roll body 1 a fluid displacement body.

In the bore 5, an insulating tube 17 is provided which is supported by a thermally insulating frustoconical support disk 18 so that the direct heat transfer from the thermal medium to the lefthand flange stub shaft 2 is reduced.

To feed the heating bores 4 of the roll body 1, every second heating bore 4 opening at the lefthand side of the roll body communicates via a radial groove 11 and the annular groove 13 with radial bores 12 opening into the compartment 8*a* behind the partition 8 and into which the passage 6*a* of the tube 6 opens.

The righthand ends of these bores 4 are connected by bridges 15 to the alternating heating bores 20 which, in turn, communicate at the lefthand end with radial bores 19 formed in the lefthand flange 32 and disposed in an array axially heated of the grooves 11. The radial bores 19 are of a distribution identical to alternating heating bores 4 and communicate with the alternating heating bores 4 via the axial bores 20 which ae formed in the flange 23. The return flow, therefore, from the heating bores 4 and the bores 20 which communicate therewith, passes via the radial bores 19 into the annular chamber 8*b* heated of the partition 8 and through the passage 5*a* between the insulating tube 17 and the pipe 6.

The radial bores 19 are closed at their outer ends by plugs 22 screwed into these bores or fastened in place by welding or by other means.

Figure 5:
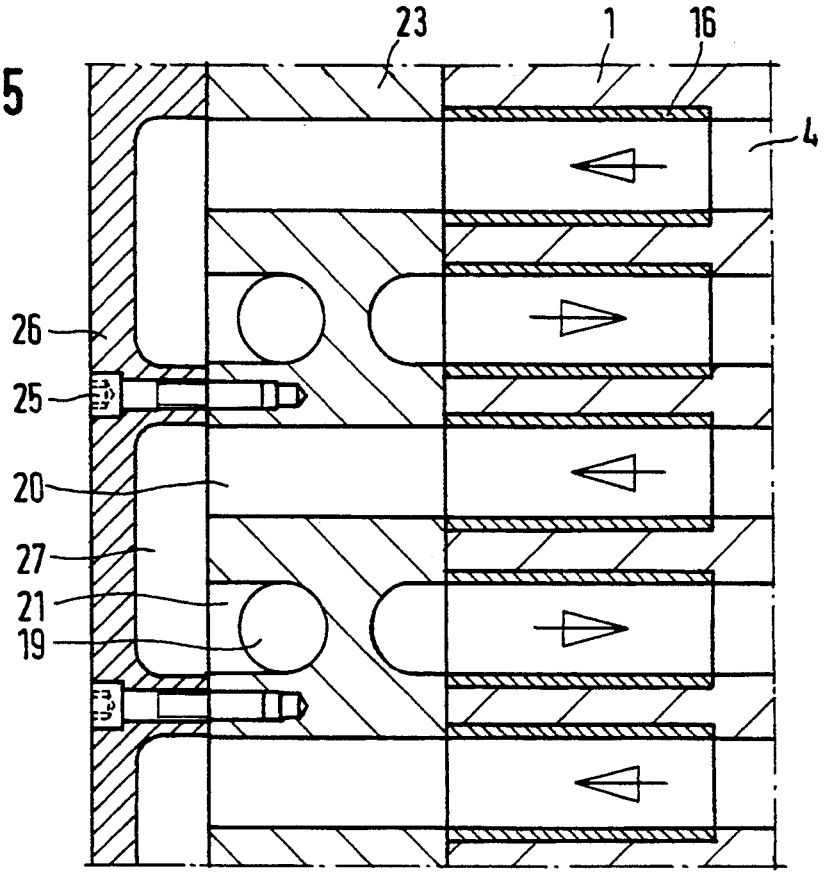
FIG. 5 is a sectional view which is developed, showing an alternative for the connection shown in FIG. 3.

Each of the radial bores 19, moreover, may communicate with an axial bore 21 which can be aligned with a respective heating bore 21 and can be connected to a successive heating bore 4 by a bridge 27 formed in a ring 26 which may be welded in a groove of the respective flange 23 or held in place by screws 25 (see FIGS. 4 and 5).

The bridges 27 may open at the base of a groove 24 at which the respective bores 4 can open. The bridges may thus connect alternate bores 4 with the radial passages 19 so that the passages 19 can be aligned with the grooves 11 in common radial planes leaving, within the pitch circle 4*e* of the bores 4, space for the bolts 3.

As a consequence, there is a direct connection to the feedpipe 6 via bores 12, annular groove 13 and grooves 11 of the heating bores 4 whose mouths can be provided with insulating sleeves 16 as previously described.

Each second heating bore 4, connected to a respective first heating bore 4 by a respective bridge 15 or to other heating bores via a common groove so that at least two heating bores are connected in series, return the thermal medium via the axial bores 20, bridge recesses 27 of the ring 26, connecting bores and radial bores 19 to the chamber 8*b* and then to the passage 5*a*.

This allows the blind bores for the bolts 3 in the body 1 and the throughbores for the bolts in the flange to be accommodated in sufficient space between the radial bores 19.

Since there are fewer feed bores 12 than grooves 11, the feed bores 12 are individually of larger cross section than the channels 11. This construction is simpler and less expensive since it eliminates the need for inclined feed bores 14 in the roll body 1, constituted of harder cast metal than the stub shafts 2.

Figure 6:
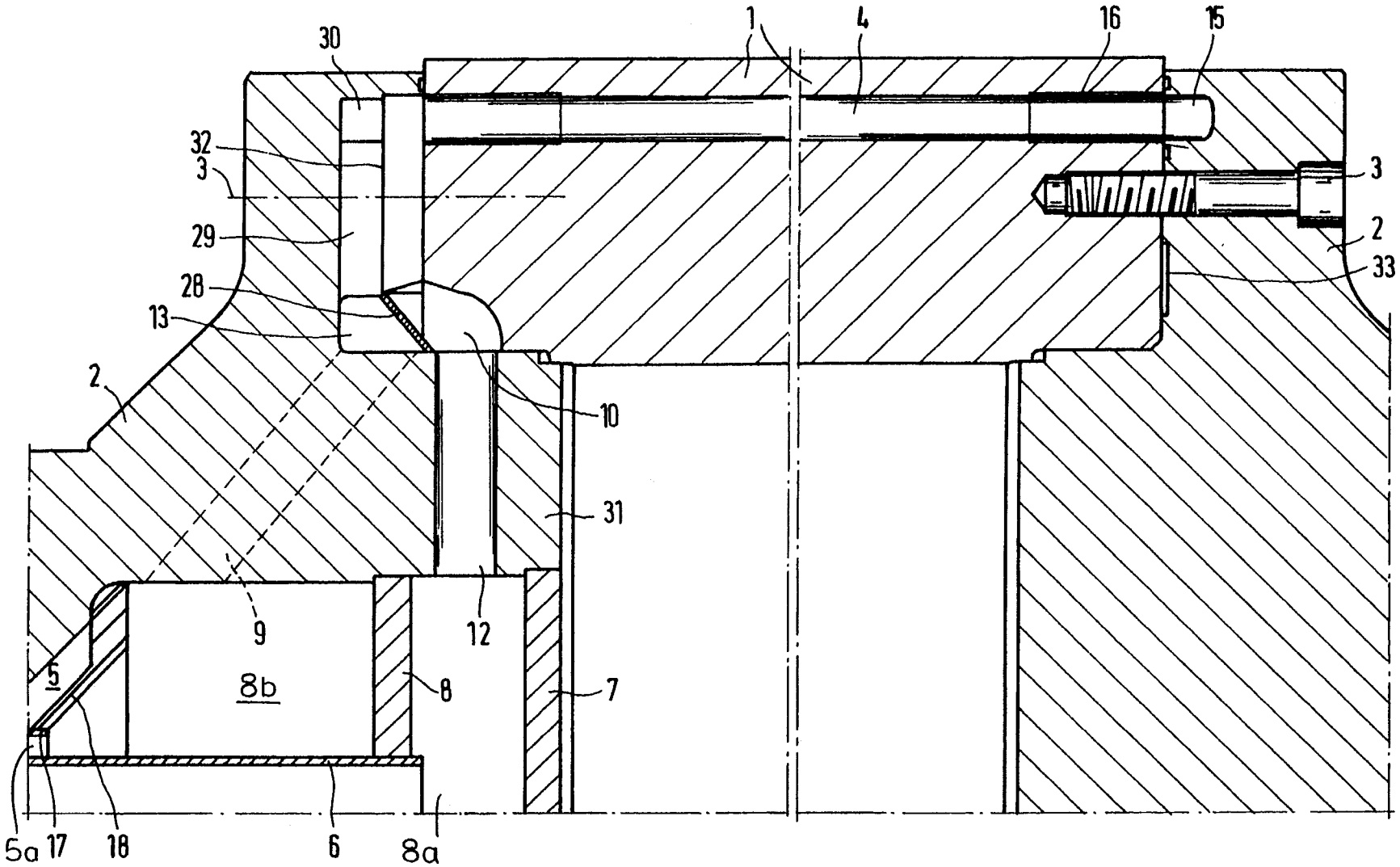
FIG. 6 is a view similar to FIG. 1 of another embodiment having grooves in only one of the flanged stub shafts and connecting bores distributed therein.

FIG. 6 illustrates another embodiment of the invention wherein 2 annular grooves 10 and 13 are provided and are separated from one another by a conical disk 28. Here again parts corresponding to those of previously described FIGS. bear the same reference numerals.

The roll body 1 is again connected with the flanges of the flanged stub shafts 2 by bolts 3. In the feedbore 5 of the lefthand flange stub shaft 2, an inlet pipe 6 is provided and is supported by the paritition disk 8 while an insulating pipe 17 can be supported by the support disk 18 in the manner described in connection with FIGS. 3 and 4. The annular groove 13 is connected by return flow bores 9 of reduced number and greater cross section than the radial grooves 29 with which the annular groove 13 communicates.

Each of the radial grooves 29 can be connected to a cross bridge 30 (see FIG. 7) and then to one of the heating bores 4. The alternating heating bores 4 communicating via square tubes 32 received in the grooves 29 and communicating via annular grooves 10 in the body 1 and radial bores 12 with the chamber 8*a* between the partitions 8 and 7 to feed the heating bores 4 which are bridged at the other bridge via the bridges 15.

Each of the radial tubes 32 has a lower opening terminating at the upper edge of the conical disk 28 and a lateral opening at its upper end which communicates with the mouth of a respective heating bore 4. Thus as generally described previously, the feed is effected via the tube 6, the compartment 8*a*, the radial bores 30, the annular groove 10, teh radial tubes 32 and alternating heating bores 4 while the return is via the bridges 15 to the other heating bores 4, back to the bridge 30 and then via the grooves 29 to the annular groove 13 and the inclined bores 9 to the compartment 8*b* and hence via the passage 5*a* between the tubes 6 and 17 out of the roll.

In this embodiment as well, insulating bushings 16 can be provided at the mouths of the heating bores 4 while insulating tube 17 and insulating disk 18 serve to prevent heating of the lefthand stub shaft 2. The radial tube 32 may also be composed of plastic or from other thermally insulating material or material of low thermal conductivity. If further thermal insulation, between the heating body and the flanged stub shafts 2, flat air chambers 33 can be provided.

Figure 7:
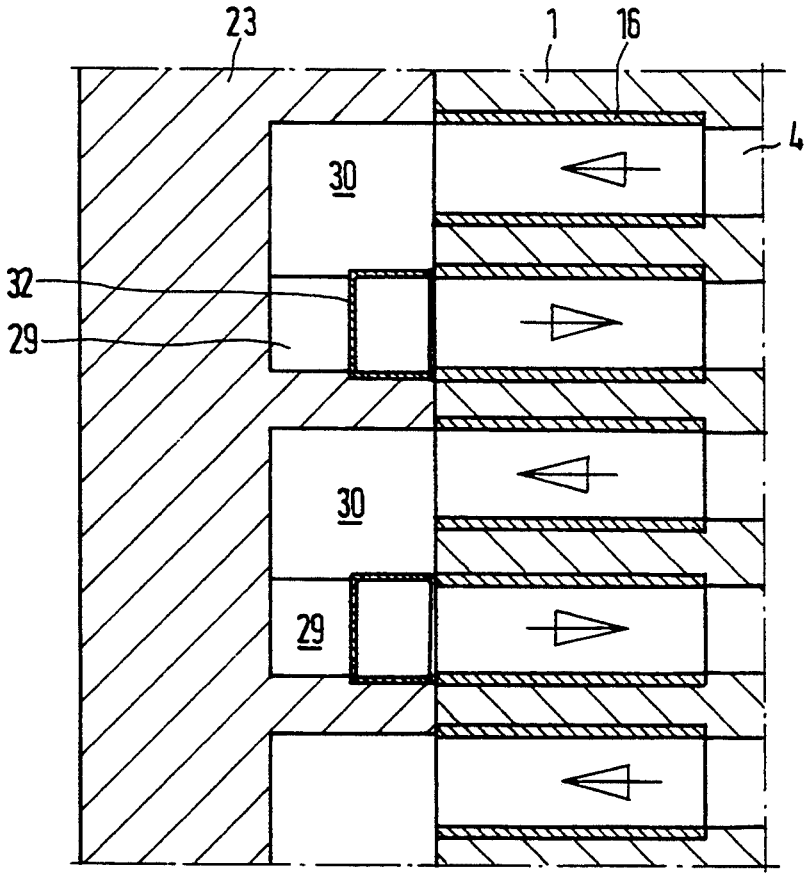
FIG. 7 is a developed view of interconnections which can be used in the system of FIG. 6.
Figure 8:
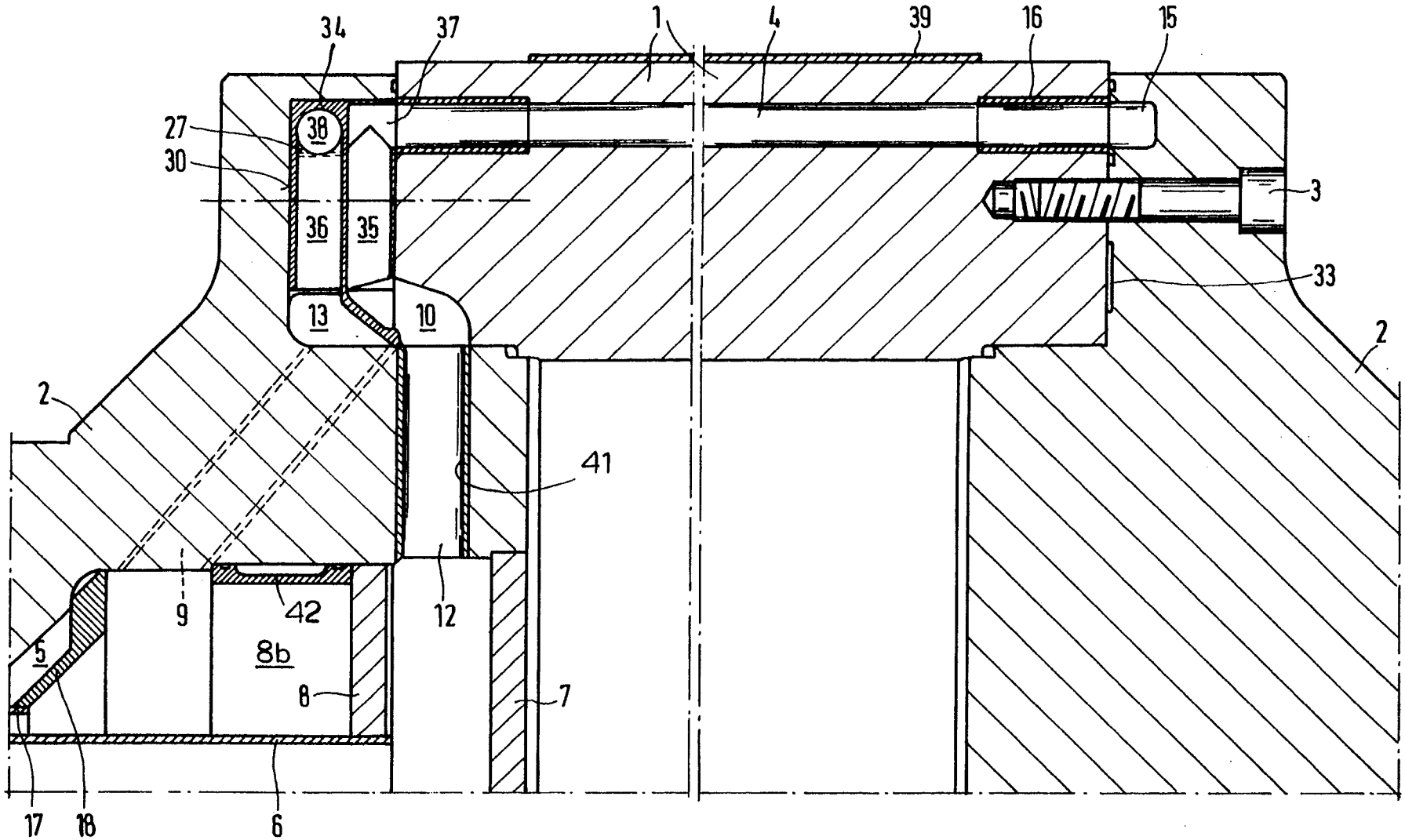
FIG. 8 is another view similar to FIG. 1 but of a different embodiment in which the grooves are again formed in one of the flanges.
Figure 9:
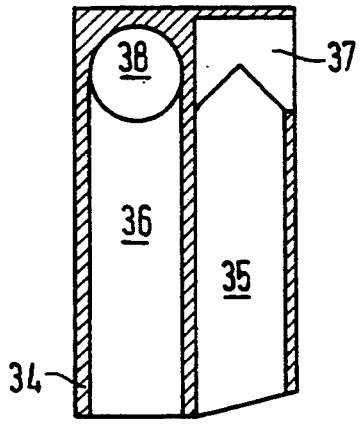
FIG. 9 is a horizontal section through a connecting housing of the embodiment of FIG. 8.
Figure 9A:
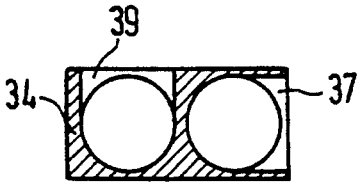
FIG. 9*a* is a vertical section through the latter.
Figure 10:
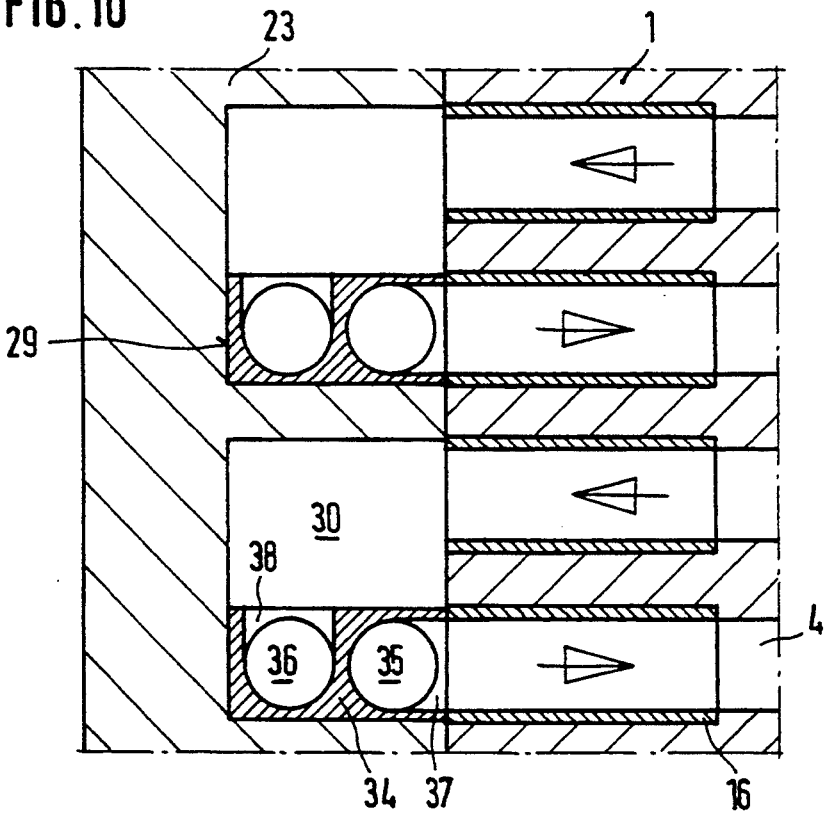
FIG. 10 is a variant of the connections for the system of FIG. 8 also shown in cross section.

FIG. 8 shows a variant of the embodiment of FIGS. 6 and 7. In the grooves 29, guide housings 34 can be fitted which contain both guide paths for the liquid, namely, the feedpath and the return path. Thus the feedpath can include the radial passages 12 and the annular groove 10 as well as radial compartments 35 which communicate via openings 27 with the mouths of alternating bores 4. The chambers 36, however, are located rearwardly of the chambers 35 and are connected by transverse passages 38 with the bridges 30 with which the other heating bores 4 communicate to receive the medium and deliver it to the annular grooves 13.

FIG. 8 also shows the web 39 which is rolled by the calender, e.g. a paper web which is dried by engagement with the heated surface of the calender roll. Outside the heating region, the heating of the roll is to minimized and hence the insulating sleeves 16 and the insulating tube 17 with its insulating support body 18. The groove 29 is insulating by the low thermal conductivity material of the housing 34 and other passages within the roll may be insulated as shown by the insulating layer 41 of the bores 12. An insulating ring 42 may line the flanged stub shaft 2 around the chamber 8*b*. Partitions 7 and 8 may be of insulating material as well. As practical matter, the only uninsulated part of the passages or bores mentioned may be the lengths of the heating bores 4 lying directly inwardly of the web 39.

We claim:

1. A controlled-temperature roll, comprising:

a hollow roll body having a cylindrical peripheral surface and a multiplicity of mutually parallel heat transfer bores for a heating medium extending parallel to an axis of the roll body and terminating at respective opposite ends of said roll body, said bores lying in a circular array close to said peripheral surface and such that axes of said bores lie generally along a bore array circle centered on said axis of the roll body;

a respective flanged stub shaft at each of said ends, each flanged stub shaft comprising:

a circular flange lying against the respective end of said roll body, a shaft stub projecting axially from the respective flange and coaxial with said flange and said roll body, and axial stub bores formed in at least one of said shaft stubs for delivering said heating medium to and discharging said heating medium from said heat transfer bores;

a respective circular array of flange bolts extending parallel to said axis of the roll body and traversing each flange for securing the respective flange to the respective end of the roll body, said flange bolts having flange bolt axes lying along a flange bolt circle centered on said axis of the roll body, a radius of said bore array circle exceeding a radius of said flange bolt circle; and passages including at least one chamber in the form of an annular groove formed in faces of said flanges confronting said ends of said roll body, connected to said stub bores and communicating with said heat transfer bores whereby mouths of said heat transfer bores open into said passages.

* * * * *